United States Patent [19]

Lund et al.

[11] Patent Number: 5,039,444

[45] Date of Patent: Aug. 13, 1991

[54] AZEOTROPE-LIKE COMPOSITIONS OF DICHLORO-TRIFLUOROETHANE, CYCLOPENTANE AND OPTIONALLY NITROMETHANE

[75] Inventors: Earl A. E. Lund, West Seneca; Rajat S. Basu; David P. Wilson, both of Williamsville; Ellen L. Swan, Ransomville, all of N.Y.

[73] Assignee: Allied-Signal Inc., Morris Township, Morris County, N.J.

[21] Appl. No.: 450,774

[22] Filed: Dec. 14, 1989

[51] Int. Cl.[5] ..... C11D 7/30; C11D 7/50

[52] U.S. Cl. ..... 252/171; 134/12; 134/38; 134/39; 134/40; 252/153; 252/162; 252/172; 252/364; 252/DIG. 9

[58] Field of Search ..... 252/67, 69, 162, 170, 252/171, 564, DIG. 9, 172

[56] References Cited

U.S. PATENT DOCUMENTS 4,816,175 3/1989 Lurel et al. ..... 252/171

OTHER PUBLICATIONS

L. H. Horsley, in Advances in Chemistry Series 116, Azeotropic Data III, 72 (1973).

*Primary Examiner*—Paul Lieberman
*Assistant Examiner*—A. Beadles-Hay
*Attorney, Agent, or Firm*—C. D. Szuch; J. P. Friedenson

[57] ABSTRACT

Stable azeotrope-like compositions comprising dichlorotrifluoroethane, cyclopentane and nitromethane which are useful in a variety of industrial cleaning applications.

10 Claims, No Drawings

AZEOTROPE-LIKE COMPOSITIONS OF DICHLORO-TRIFLUOROETHANE, CYCLOPENTANE AND OPTIONALLY NITROMETHANE

FIELD OF THE INVENTION

This invention relates to azeotrope-like mixtures of dichlorotrifluoroethane, cyclopentane and optionally nitromethane. These mixtures are useful in a variety of vapor degreasing, cold cleaning and solvent cleaning applications including defluxing.

BACKGROUND OF THE INVENTION

Fluorocarbon based solvents have been used extensively for the degreasing and otherwise cleaning of solid surfaces, especially intricate parts and difficult to remove soils.

In its simplest form, vapor degreasing or solvent cleaning consists of exposing a room-temperature object to be cleaned to the vapors of a boiling solvent. Vapors condensing on the object provide clean distilled solvent to wash away grease or other contaminants. Final evaporation of solvent from the object leaves the object free of residue. This is contrasted with liquid solvents which leave deposits on the object after rinsing.

A vapor degreaser is used for difficult to remove soils where elevated temperature is necessary to improve the cleaning action of the solvent, or for large volume assembly line operations where the cleaning of metal parts and assemblies must be done efficiently. The conventional operation of a vapor degreaser consists of immersing the part to be cleaned in a sump of boiling solvent which removes the bulk of the soil, thereafter immersing the part in a sump containing freshly distilled solvent near room temperature, and finally exposing the part to solvent vapors over the boiling sump which condense on the cleaned part. In addition, the part can also be sprayed with distilled solvent before final rinsing.

Vapor degreasers suitable in the above-described operations are well known in the art. For example, Sherliker et al., in U.S. Pat. No. 3,085,918 disclose such suitable vapor degreasers comprising a boiling sump, a clean sump, a water separator, and other ancillary equipment.

Cold cleaning is another application where a number of solvents are used. In most cold cleaning applications the soiled part is either immersed in the fluid or wiped with cloths soaked in solvents and allowed to air dry.

Recently, nontoxic, nonflammable fluorocarbon solvents liks trichlorotrifluoroethane have been used extensively in degreasing applications and other solvent cleaning applications. Trichlorotrifluoro-ethane has been found to have satisfactory solvent power for greases, oils, waxes and the like. It has therefore found widespread use for cleaning electric motors, compressors, heavy metal parts, delicate precision metal parts, printed circuit boards, gyroscopes, guidance systems, aerospace and missile hardware, aluminum parts and the like.

The art has looked towards azeotropic compositions having fluorocarbon components because the fluorocarbon components contribute additionally desired characteristics, such as polar functionality, increased solvency power, and stabilizers. Azeotropic compositions are desired because they do not fractionate upon boiling. This behavior is desirable because, in the previously described vapor degreasing equipment with which these solvents are employed, redistilled material is generated for final rinse-cleaning. Thus, the vapor degreasing system acts as a still. Therefore, unless the solvent composition is essentially constant boiling, fractionation will occur and undesirable solvent distribution may act to upset the cleaning and safety of processing. For example, preferential evaporation of the more volatile components of the solvent mixtures, would result in mixtures with changed compositions which may have less desirable properties, such as lower solvency towards soils, less inertness towards metal, plastic or elastomer components, and increased flammability and toxicity.

The art is continually seeking new fluorocarbon-based azeotropic mixtures or azeotrope-like mixtures which offer alternatives for vapor degreasing and other cleaning applications. Currently, fluorocarbon-based azeotrope-like mixtures are of particular interest, because they are considered to be stratospherically safe substitutes for presently used fully halogenated chlorofluorocarbons. The latter have been implicated in causing environmental problems in connection with the depletion of the earth's protective ozone layer. Mathematical models have substantiated that hydrochlorofluorocarbons, like dichlorotrifluoroethane (HCFC-123 or HCFC-123a), have a much lower ozone depletion potential and global warming potential than the fully halogenated species.

Accordingly it is an object of the invention to provide novel environmentally acceptable azeotropic compositions based on dichlorotrifluoroethane which are useful in a variety of industrial cleaning applications.

It is another object of the invention to provide azeotrope-like compositions which are liquid at room temperature and which will not fractionate under conditions of use.

A further object of the invention is to provide azeotrope-like compositions which are nonflammable in both the liquid and vapor phases.

Other objects and advantages of the invention will become apparent from the following description.

SUMMARY OF THE INVENTION

The invention relates to novel azeotrope-like compositions which are useful in a variety of industrial cleaning applications. Specifically, the invention relates to compositions based on dichlorotrifluoroethane which are essentially constant boiling, environmentally acceptable, non-fractionating and which remain liquid at room temperature.

DETAILED DESCRIPTION OF THE INVENTION

In accordance with the invention, novel azeotrope-like compositions have been discovered comprising dichlorotrifluoroethane, cyclopentane and optionally nitromethane. Dichlorotrifluoroethane exists in three isomeric forms, 1,1-dichloro-2,2,2-trifluoroethane (HCFC-123), 1,2-dichloro-1,2,2-trifluoroethane (HCFC-123a), and 1,1-dichloro-1,2,2-trifluoroethane (HCFC-123b). However, for purposes of this invention, dichlorotrifluoroethane will refer only to the HCFC-123 and HCFC-123a isomers. Each of these isomers exhibits the properties of the invention. Hence, either isomer may be used as well as mixtures of the isomers in any proportion.

Because dichlorotrifluoroethane is polar while cyclopentane is non-polar, when these components are combined in effective amounts they produce a degreasing composition capable of dissolving oils with polar and non-polar components. Nitromethane stabilizes the composition when used in effective amounts. Thus, when the three components are combined in effective amounts, a stable azeotropic degreasing composition results.

The azeotrope-like compositions of the invention comprise from about 95.9 to about 99.1 weight percent dichlorotrifluoroethane, from about 0.8 to about 4.0 weight percent cyclopentane and from about 0.0 to about 0.1 weight percent nitromethane and boil at about 28.2° C. ± about 1.0° C. at 760 mm Hg.

Preferably, the azeotrope-like compositions of the invention comprise from about 97.0 to about 99.1 weight percent dichlorotrifluoroethane, from about 0.8 to about 3.0 weight percent cyclopentane and from about 0.0 to about 0.1 weight percent nitromethane and boil at about 28.2° C. ± about 1.0° C. at 760 mm Hg.

When 1,1-dichloro-2,2,2-trifluoroethane is the dichlorotrifluoroethane component of the invention, the azeotrope-like compositions comprise from about 98.8 to about 99.1 weight percent 1,1-dichloro-2,2,2-trifluoroethane, from about 0.8 to about 1.1 weight percent cyclopentane and from about 0.0 to about 0.1 weight percent nitromethane and boil at about 27.2° C. at 760 mm Hg.

When 1,2-dichloro-1,2,2-trifluoroethane is the dichlorotrifluoroethane component the invention, the azeotrope-like compositions comprise from about 97.0 to about 98.5 weight percent 1,2-dichloro-1,2,2-trifluoroethane, from about 1.5 to about 3.0 weight percent cyclopentane and from about 0.0 to about 0.1 weight percent nitromethane and boil at about 29.3° C. at 760 mm Hg.

All compositions within the above-identified ranges, as well as certain compositions outside the indicated ranges, are azeotrope-like, as defined more particularly below.

The compositions of the invention containing a mixture of HCFC-123 and HCFC-123a behave like azeotropic compositions because the separate ternary azeotrope-like compositions containing HCFC-123 and HCFC-123a have boiling points so close to one another that they are indistinguishable for practical purposes.

Such compositions based on HCFC-123 possess constant or essentially constant boiling points of about 27.2° C. at 760 mm of Hg. Such compositions based on HCFC-123a possess constant or essentially constant boiling points of about 29.3° C. at 760 mm of Hg. The precise or true azeotrope compositions have not been determined but have been ascertained to be within the above ranges. Regardless of where the true azeotropes lie, all compositions within the indicated ranges, as well as certain compositions outside the indicated ranges, are azeotrope-like, as defined more particularly below.

These azeotrope-like compositions are stable, safe to use and the preferred compositions of the invention are nonflammable (exhibit no flash point when tested by the Tag Open Cup test method —ASTM D 1310-86) and exhibit excellent solvency power. These compositions are particularly effective when employed in conventional degreasing units for the dissolution of lubricating and cutting oils and the cleaning of such oils from solid surfaces.

From fundamental principles, the thermodynamic state of a system (pure fluid or mixture) is defined by four variables: pressure, temperature, liquid composition and vapor composition, or P-T-X-Y, respectively. An azeotrope is a unique characteristic of a system of two or more components where X and Y are equal at a stated P and T. In practice, this means that the components of a mixture cannot be separated during distillation or in vapor phase solvent cleaning when that distillation is carried out at a fixed T (the boiling point of the mixture) and a fixed P (atmospheric pressure).

For purposes of this discussion, by azeotrope-like composition is intended to mean that the composition behaves like a true azeotrope in terms of its constant boiling characteristics or tendency not to fractionate upon boiling or evaporation. Such composition may or may not be a true azeotrope. Thus, in such compositions, the composition of the vapor formed during boiling or evaporation is identical or substantially identical to the original liquid composition. Hence, during boiling or evaporation, the liquid composition, if it changes at all, changes only minimally. This is contrasted with non-azeotrope-like compositions in which the liquid composition changes substantially during boiling or evaporation.

Thus, one way to determine whether a candidate mixture is "azeotrope-like" within the meaning of this invention, is to distill a sample thereof under conditions (i.e. resolution —number of plates) which would be expected to separate the mixture into its components. If the mixture is non-azeotropic or non-azeotrope-like, the mixture will fractionate, i.e., separate into its various components with the lowest boiling component distilling off first, and so on. If the mixture is azeotrope-like, some finite amount of a first distillation cut will be obtained which contains all of the mixture components and which is constant boiling or behaves as a single substance. This phenomenon cannot occur if the mixture is not azeotrope-like i.e., it is not part of an azeotropic system. If the degree of fractionation of the candidate mixture is unduly great, then a composition closer to the true azeotrope must be selected to minimize fractionation. Of course, upon distillation of an azeotrope-like composition such as in a vapor degreaser, the true azeotrope will form and tend to concentrate.

It follows from the above discussion that another characteristic of azeotrope-like compositions is that there is a range of compositions containing the same components in varying proportions which are azeotrope-like. All such compositions are intended to be covered by the term azeotrope-like as used herein. As an example, it is well known that at different pressures, the composition of a given azeotrope will vary at least slightly and changes in distillation pressures also change, at least slightly, the distillation temperatures. Thus, an azeotrope of A and B represents a unique type of relationship having a variable composition depending on temperature and/or pressure. Accordingly, another way of defining azeotrope-like within the meaning of this invention is to state that such mixtures boil within about ±1° C. (at about 760 mm Hg ±25 mm.) of the boiling point of the preferred compositions disclosed herein (i.e., closest to the true azeotrope).

In the process embodiment of the invention, the azeotrope-like compositions of the invention may be used to clean solid surfaces by treating said surfaces with said compositions in any manner well known to the art such as by dipping or spraying or use of conventional degreasing apparatus.

The HCFC-123, HCFC-123a, cyclopentane and nitromethane components of the invention are all commercially available. Preferably they should be used in sufficiently high purity so as to avoid the introduction of adverse influences upon the solvency properties or constant boiling properties of the system.

EXAMPLE 1

This example confirms the existence of azeotropes between 1,1-dichloro-2,2,2-trifluoroethane, cyclopentane and nitromethane via the method of distillation. A five-theoretical-plate Oldershaw distillation column with a cold water condensed, manual liquid dividing head was used for this Example. Typically, approximately 350 cc of liquid were charged to the distillation pot. The liquid was a mixture comprised of various combinations of HCFC-123, cyclopentane and nitromethane.

The mixture was heated at total reflux for about one hour to ensure equilibration. For most of the runs, the distillate was obtained using a 5:1 reflux ratio at a boil-up rate of 400–500 grams per hr. Approximately 300 cc of product were distilled and 6 approximately equivalent sized overhead cuts were collected. The vapor temperature (of the distillate), pot temperature, and barometric pressure were monitored. A constant boiling fraction was collected and analyzed by gas chromatography to determine the weight percentages of its components. To normalize observed boiling points during different days to 760 mm of mercury pressure, the approximate normal boiling points of HCFC-123 mixtures were estimated by applying a barometric correction factor of about 29.8 mm Hg/°C., to the observed values. However, it is to be noted that this corrected boiling point is generally accurate up to ± 0.4° C. and serves only as a rough comparison of boiling points determined on different days.

Supporting distillation data for the mixtures studied are shown in TABLE I.

TABLE I

| HCFC-123 | Cyclopentane | Nitromethane |
|---|---|---|
| STARTING MATERIAL (WT %) | | |
| 98.8 | 1.1 | 0.1 |
| CONSTANT BOILING FRACTION (WT %) | | |
| 98.1 | 0.8 | 0.01 |

| Vapor Temp. (°C.) | Barometric Pressure (mm of Hg) | Boiling Point Corrected to 760 mm Hg (°C.) |
|---|---|---|
| 27.1 | 741.1 | 27.2 |

From the above, it is readily apparent that additional constant boiling or essentially constant boiling mixtures of the same components can be identified by anyone of ordinary skill in this art by the method described. No attempt was made to fully characterize and define the true azeotrope in the system comprising HCFC-123, cyclopentane and nitromethane, nor the outer limits of its compositional ranges which are constant boiling. Anyone skilled in the art can readily ascertain other constant boiling or essentially constant boiling mixtures.

EXAMPLES 2–3

This set of examples confirms the existence of azeotropes between 1,2-dichloro-1,2,2-trifluoroethane, cyclopentane, and nitromethane, via the method of distillation.

Examples 2–3 were performed under the same conditions outlined in Example 1 above.

TABLE II

| Example (Distillation) | HCFC-123a | Cyclopentane | Nitromethane |
|---|---|---|---|
| STARTING MATERIAL (WT %) | | | |
| 2 | 95.9 | 4.0 | 0.1 |
| 3 | 97.8 | 2.1 | 0.1 |
| CONSTANT BOILING FRACTION (WT %) | | | |
| 2 | 97.0 | 3.0 | 0.01 |
| 3 | 98.5 | 1.5 | 0.01 |

| Example | Vapor Temp. (°C.) | Barometric Pressure (mm Hg) | Boiling Point Corrected to 760 mm Hg (°C.) |
|---|---|---|---|
| 2 | 29.1 | 744.0 | 29.2 |
| 3 | 29.3 | 744.0 | 29.4 |
| | | Mean: | 29.3 ± 0.1 |

Examples 2–3 illustrate that HCFC-123a, cyclopentane, and nitromethane form a constant boiling mixture.

EXAMPLE 4

This example shows that a minimum in the boiling point versus compositive curve occurs for the binary 1,1-dichloro-2,2,2-trifluoroethane/cyclopentane composition. Specifically, the minimum occurs from about 99.7 to about 93.3 weight percent 1,1-dichloro-2,2,2-trifluoroethane and from about 0.3 to about 6.73 weight percent cyclopentane; indicating that a constant boiling composition forms in the neighborhood of this range.

The temperature of the boiling liquid mixture was measured using an ebulliometric technique similar to that described by W. Swietoslawski in Ebulliometric Measurements, Reinhold Publishing Corp., (1945). The ebulliometer consisted of a sperical flask which was charged with a measured amount, generally 3–6 $cm^3$, of the HCFC-123. The flask was partially submerged in a constant temperature bath which served to heat the liquid contained in the flask. The liquid was stirred vigorously with a magnetic stirrer. The temperature of the boiling system was measured using either a quartz-sheathed platinum resistance thermometer or a glass-sheathed thermistor which had been calibrated against a platinum resistance thermometer standard. In each case the temperature detector was placed just above the surface of the boiling liquid and was continually washed with condensed vapor. The system was operated under total reflux and temperature measurements, accurate to ±0.01° C., recorded after steady state was attained. The prevailing barometric pressure was also recorded. Boiling point versus composition data were obtained by titrating measured aliquots of cyclopentane into the ebulliometer, using either a manual syringe or a microprocessor controlled syringe.

Table III shows the boiling point measurements, at 760 mm Hg, for various mixtures of HCFC-123 and cyclopentane. Over the compositional range shown, the boiling point changed by about 0.5° C.

TABLE III

| EBULLIOMETER DATA | | |
|---|---|---|
| Parts by weight Cyclopentane | Parts by weight HCFC-123 | Boiling Point at 760 mm HG (°C.) |
| 0.00 | 100.00 | 27.90 |
| 0.40 | 99.60 | 27.93 |
| 0.84 | 99.16 | 27.96 |
| 1.26 | 98.84 | 27.99 |
| 1.67 | 98.33 | 28.02 |
| 2.08 | 97.92 | 28.05 |
| 2.48 | 97.52 | 28.08 |
| 2.88 | 97.12 | 28.11 |
| 3.28 | 96.72 | 28.14 |
| 3.68 | 96.32 | 28.17 |
| 4.08 | 95.92 | 28.20 |
| 4.48 | 95.52 | 28.23 |
| 4.88 | 95.12 | 28.26 |
| 5.28 | 94.72 | 28.32 |
| 5.68 | 94.32 | 28.35 |
| 6.08 | 93.92 | 28.38 |
| 6.48 | 93.52 | 28.41 |
| 6.73 | 93.27 | 28.44 |

What is claimed is:

1. Azeotrope-like compositions consisting essentially of from about 95.9 to about 99.1 weight percent dichlorotrifluoroethane selected from the group consisting of 1,1-dichloro-2,2,2-trifluoroethane, 1,2-dichloro-1,2,2-trifluoroethane and a mixture of 1,1-dichloro-2,2,2-trifluoroethane and 1,2-dichloro-1,2,2-trifluoroethane, from about 0.8 to about 4.0 weight percent cyclopentane and from about 0.0 to about 0.1 weight percent nitromethane wherein the azeotrope-like components of the composition consist of dichlorotrifluoroethane, cyclopentane and optionally nitromethane and boil at about 28.2° C. at 760 mm Hg.

2. The azeotrope-like compositions of claim 1 wherein said compositions consist essentially of from about 97.0 to about 99.1 weight percent dichlorotrifluoroethane, from about 0.8 to about 3.0 weight percent cyclopentane and from about 0.0 to about 0.1 weight percent nitromethane and boil at about 28.2° C. at 760 mm Hg.

3. The azeotrope-like compositions of claim 1 wherein said compositions consist essentially of from about 98.8 to about 99.1 weight percent 1,1-dichloro-2,2,2-trifluoroethane, from about 0.8 to about 1.1 weight percent cyclopentane, and from about 0.0 to about 0.1 weight percent nitromethane which boil at about 27.2° C. at 760 mm Hg.

4. The azeotrope-like compositions of claim 1 wherein said compositions consist essentially of from about 97.0 to about 98.5 weight percent 1,2-dichloro-1,2,2-trifluoroethane, from about 1.5 to about 3.0 weight percent cyclopentane and from about 0.0 to about 0.1 weight percent nitromethane and which boil at about 29.3° C. at 760 mm Hg.

5. Azeotrope-like compositions consisting essentially of from about 95.9 to about 99.1 weight percent dichlorotrifluoroethane selected from the group consisting of 1,1-dichloro-2,2,2-trifluoroethane, 1,2-dichloro-1,2,2-trifluoroethane and a mixture of 1,1-dichloro-2,2,2-trifluoroethane and 1,2-dichloro-1,2,2-trifluoroethane, from about 0.8 to about 4.0 weight percent cyclopentane and from about 0.0 to about 0.1 weight percent nitromethane wherein the azeotrope-like components of the composition consist of dichlorotrifluoroethane, cyclopentane and optionally nitromethane and boil at about 28.2° C. ± 1.0° C. at 760 mm Hg.

6. Azeotrope-like compositions consisting essentially of from about 97.0 to about 99.1 weight percent dichlorotrifluoroethane selected from the group consisting of 1,1-dichloro-2,2,2-trifluoroethane, 1,2-dichloro-1,2,2-trifluoroethane and a mixture of 1,1-dichloro-2,2,2-trifluoroethane and 1,2-dichloro-1,2,2-trifluoroethane, from about 0.8 to about 3.0 weight percent cyclopentane and from about 0.0 to about 0.1 weight percent nitromethane wherein the azeotrope-like components of the composition consist of dichlorotrifluoroethane, cyclopentane and optionally nitromethane and boil at about 28.2° C.±1.0° C. at 760 mm Hg.

7. A method of cleaning a solid surface comprising treating said surface with an azeotrope-like composition of claim 1.

8. A method of cleaning a solid surface comprising treating said surface with an azeotrope-like composition of claim 2.

9. A method of cleaning a solid surface comprising treating said surface with an azeotrope-like composition of claim 3.

10. A method of cleaning a solid surface comprising treating said surface with an azeotrope-like composition of claim 4.

* * * * *